US005771698A

United States Patent [19]

Abel

[11] Patent Number: 5,771,698

[45] Date of Patent: Jun. 30, 1998

[54] APPARATUS AND METHOD FOR CREATING AND RESURFACING ICE

[75] Inventor: Thomas H. Abel, Hudson, Wis.

[73] Assignee: Abel Ice, Inc., Hudson, Wis.

[21] Appl. No.: 796,203

[22] Filed: Feb. 7, 1997

Related U.S. Application Data

[60] Provisional application No. 60/ 011,404, Feb. 9, 1996.

[51] Int. Cl.[6] ..... F25C 3/02

[52] U.S. Cl. ..... 62/66; 62/235; 401/137; 401/139

[58] Field of Search ..... 62/235, 66; 239/754; 401/137–139, 203, 204, 285, 289

[56] References Cited

U.S. PATENT DOCUMENTS

| | | | |
|---|---|---|---|
| 2,316,326 | 4/1943 | Garin | 401/203 |
| 2,746,072 | 5/1956 | Lumpkin | 239/754 |
| 3,023,971 | 3/1962 | Milhous | 401/139 |
| 3,110,055 | 11/1963 | Merrill | 401/137 |
| 3,134,129 | 5/1964 | Allen | 401/137 |
| 3,457,015 | 7/1969 | Taber | 401/137 |
| 3,771,188 | 11/1973 | Guth | 401/137 |
| 3,832,069 | 8/1974 | Petsch | 401/289 |
| 4,806,037 | 2/1989 | Berglund | 401/204 |
| 4,914,923 | 4/1990 | Duplan et al. | 62/235 |

*Primary Examiner*—William E. Tapolcai
*Attorney, Agent, or Firm*—Skinner And Associates

[57] ABSTRACT

An apparatus and method for creating and resurfacing ice for skating purposes. The apparatus comprises a rigid frame, a water dispersion member connected to the frame, a mat connected to the frame, and a water supply conduit connected to the water disperson member. This device is well suited for indoor and outdoor commercial public and private skating rinks, for community parks rinks and, for home or residential skating rinks.

18 Claims, 8 Drawing Sheets

APPARATUS AND METHOD FOR CREATING AND RESURFACING ICE

CROSS-REFERENCE TO RELATED APPLICATIONS, IF ANY

This application claims the benefit under 35 U.S.C. §119 (e) of provisional application Ser. No. 60/011,404, filed Feb. 9, 1996.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates, generally, to tools. More particularly, the invention relates to a method and apparatus for creating and resurfacing skating rink ice. The invention has particular utility in creating and resurfacing ice for small scale ice rinks in residential areas and for private residences. However, the invention also has utility for larger scale indoor commercial applications.

2. Background Information

The popularity of ice skating has increased the demand for indoor-ice time that is difficult, or in the case of towns and cities without indoor ice facilities, impossible to meet. According to statistics gathered by American Demographics 3,800,000 children from 7 and 17 years of age will participate in ice skating in the year 2000. There are currently more than 300,000 amateur hockey players in the U.S. and that number is increasing by about 10 percent a year. Using the improved ice tool of this invention to create an ice rink, one that can be built in back yards or neighborhood parks, is very appealing.

In order to build and maintain an outdoor ice rink, a maximum outside temperature of 25 degrees F. above zero to a low of minus 10 degrees F. are needed, therefore, most of the outdoor rinks are in the Midwest and Northeastern states. In those states where outdoor temperatures permit it, many outdoor rinks are being built. However, even in states with very cold temperatures a mild winter or a mid-January thaw can significantly reduce the length of the outdoor skating season. It is, therefore, important to be able make use of the short season for skating and not to waste excessive amounts of time in making ice.

The traditional methods of building an outdoor ice rink require the use of plastic liners or rigid panels. Before either can be used, all the snow must be removed and the area leveled as much as possible. Both the plastic liner and the plastic panels require that a side be built up around the perimeter of the rink area with either snow or side boards. The area was then flooded with water from a hose or water truck. Ground areas are typically uneven which results in deeper water accumulations in lower areas and much thinner accumulations in others. As the water freezes, the deeper water accumulations are subject to the formation of air pockets. These air pockets eventually break out and weaken the ice. This invention dispenses water in thin layers that can be controlled. The result is stronger, smoother rink ice and, the plastic liner and/or plastic panels can be eliminated. In addition, the tool can be used successfully on uneven ground surfaces.

The various methods mentioned and weather factors significantly impact the quality and strength of ice. If several inches of water accumulate before the water can freeze solid, the resulting ice does not have the same tenacity as ice that is built up through the application of thin layers of water, preferably about ⅛ inch thick. Thin applications of water that are allowed to freeze before another water layer is added will produce a superior quality ice. The apparatus and method of this invention allow the user to apply water in thin layers that freeze quickly.

After the initial base layer of rink ice is established, it becomes necessary to recondition the ice periodically to keep it in good shape for skating. The standard practice is to reflood the base ice with yet another layer of water using a hose or water truck. Water applied by these methods often begins to freeze before it has leveled itself or completely filled the rink area. The result is an uneven ice surface. The time typically required to complete the flooding and freezing operation can be up to a full day. This represents a significant loss of rink time for skaters. The tool of this invention provides a method and means to resurface the base ice with a thin, smooth layer of ice that freezes quickly, thereby reducing the time required to resurface the rink from a day to only a few hours or even minutes under some circumstances.

There is a definite need in both the public and private sectors for the apparatus of this invention. It provides a quick, easy method of building and maintaining rink ice at a relatively low financial cost when compared to other methods. It saves the user of the apparatus valuable time in a relatively short skating season. It helps to conserve water, a valuable natural resource and, there are no emissions to harm the atmosphere. The ice tool of this invention is portable, hand operable and easy to use while producing superior results. It is also economical, making it highly possible for a commercial rinks as well as the typical homeowner to afford. It is the general object of this invention to provide an apparatus and method which overcome the limitations and shortcomings of the prior art.

BRIEF SUMMARY OF THE INVENTION

The present invention provides a portable apparatus for creating and conditioning ice which comprises, generally:

(a) a frame structure, preferably including a handle portion for grasping by a user;

(b) a water supply conduit, preferably including at least one valve, the water supply conduit being connected to or integrated with the frame structure;

(c) a water dispersion member connected to the frame structure and water supply conduit, the water dispersion member dispersing water in a predetermined pattern; and (d) a mat member connected to the frame structure and receiving water dispersed from the water dispersion member, the mat member being adapted for contact with an external surface upon which ice is to be created or conditioned.

An individual using this tool can build a base layer for the outdoor ice rink on level or unleveled ground in a fraction of the time required to build a rink using conventional methods. The tool of this invention dispenses water in very thin layers by walking back and forth in the rink area with the ice tool until a base is established. If the temperatures are 18 degrees F. or less, layers of water can be applied almost continuously around the clock. The invention further provides a method for conditioning existing ice on either outdoor rinks or on indoor commercial and/or private ice rinks. Reconditioning is accomplished by dispersing a continuous supply of water from an external water source onto the base ice in a predetermined pattern as will be described. A mat member, upon contacting the ice, functions to smooth the water into a thin layer to be conditioned.

The features, benefits and objects of this invention will become clear to those skilled in the art by reference to the following description and drawings.

DETAILED DESCRIPTION

Figure 1:
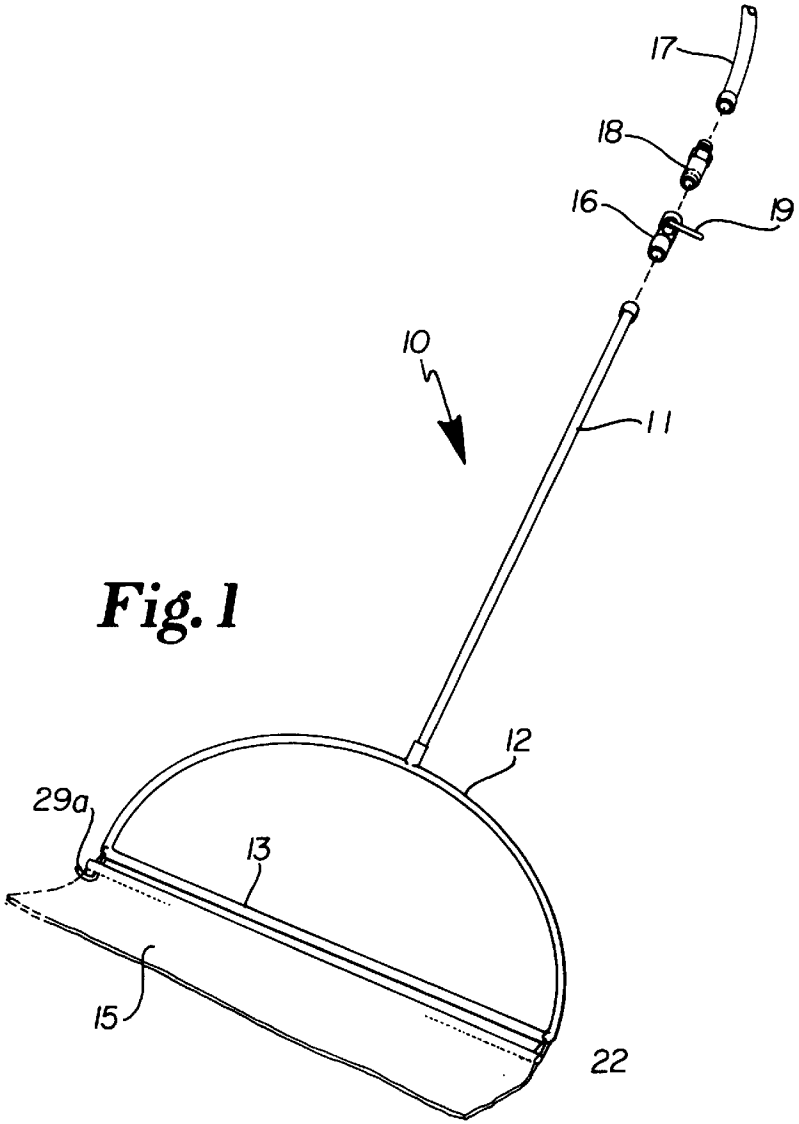
FIG. 1 is a perspective view of a first embodiment of the ice tool.

The ice tool of the present invention is illustrated and generally described below first in terms of its major structural elements and then in terms of its secondary structural and/or functional elements which cooperate to perform ice creation and conditioning or maintenance function. The several embodiments of this invention may be made in various sizes, preferably in widths of 36 to 56 inches for use on indoor or outdoor ice rink of sizes from less than 2000 square feet to approximately 8000 square feet.

I. STRUCTURE.

The first embodiment of a ice tool is generally referred to by the reference number 10, as shown in FIGS. 1–4. The ice tool 10 basically comprises a rigid frame structure including a handle 11 and a base member 12, a water dispersing member 13, a mat member 15 and a connector 16 for connecting the tool 10 to an external water supply, for example via a hose. The approximate weight of the first embodiment is 12 pounds. It is preferably 36 inches wide, but could vary in size and is recommended for use on ice rinks up to 3000 square feet.

The frame structure handle 11 and base 12, as well as the water dispensing member 13, are all constructed of a rigid material, preferably steel, copper, plastic such as PVC, or a combination of the above materials. They are preferably tubular, either rectilinear or curvilinear.

The handle 11 is preferably ¾ inch in diameter, but it could be a different diameter. The handle 11 is general disposed upright in use and has a proximal end with a connector 16 for attachment to a ¾ inch water hose. A lever 19 on the valve 16 allows the user of the ice tool to temporarily interrupt the water supply to the ice tool. The handle II is preferably hollow and serves as a conduit for water, although, a water hose could be attached to the outside of handle 11 and connected by various means to the water dispensing member 13.

The base member 12 is preferably ½ in diameter and hollow. The semi-circular base member 12 can be attached to the handle 11 by means of a T-fitting 61 or a unibody structure could be made by various means such as, molding or welding the members together. The base member 12 is connected to the water dispensing member 13 by various methods such as hollow elbow fittings 14*a* and *b* The continuous inner lumen provided conveys water to the water dispensing member 13.

Figure 5:
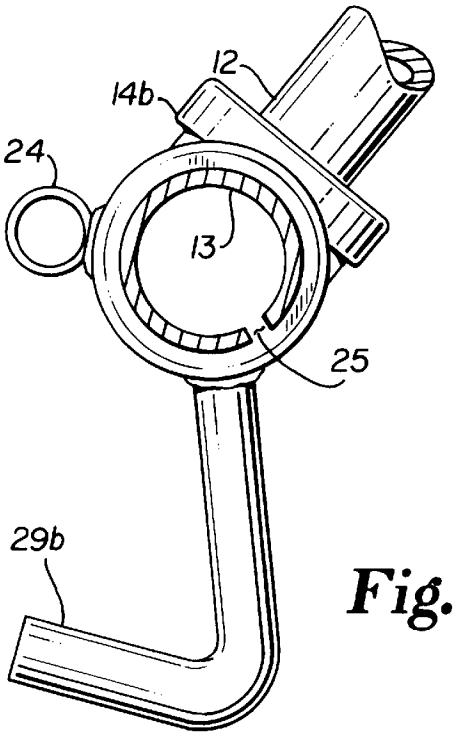
FIG. 5 is a cross-sectional view of the ice tool taken at the point shown in FIG. 2.
Figures 2, 4:
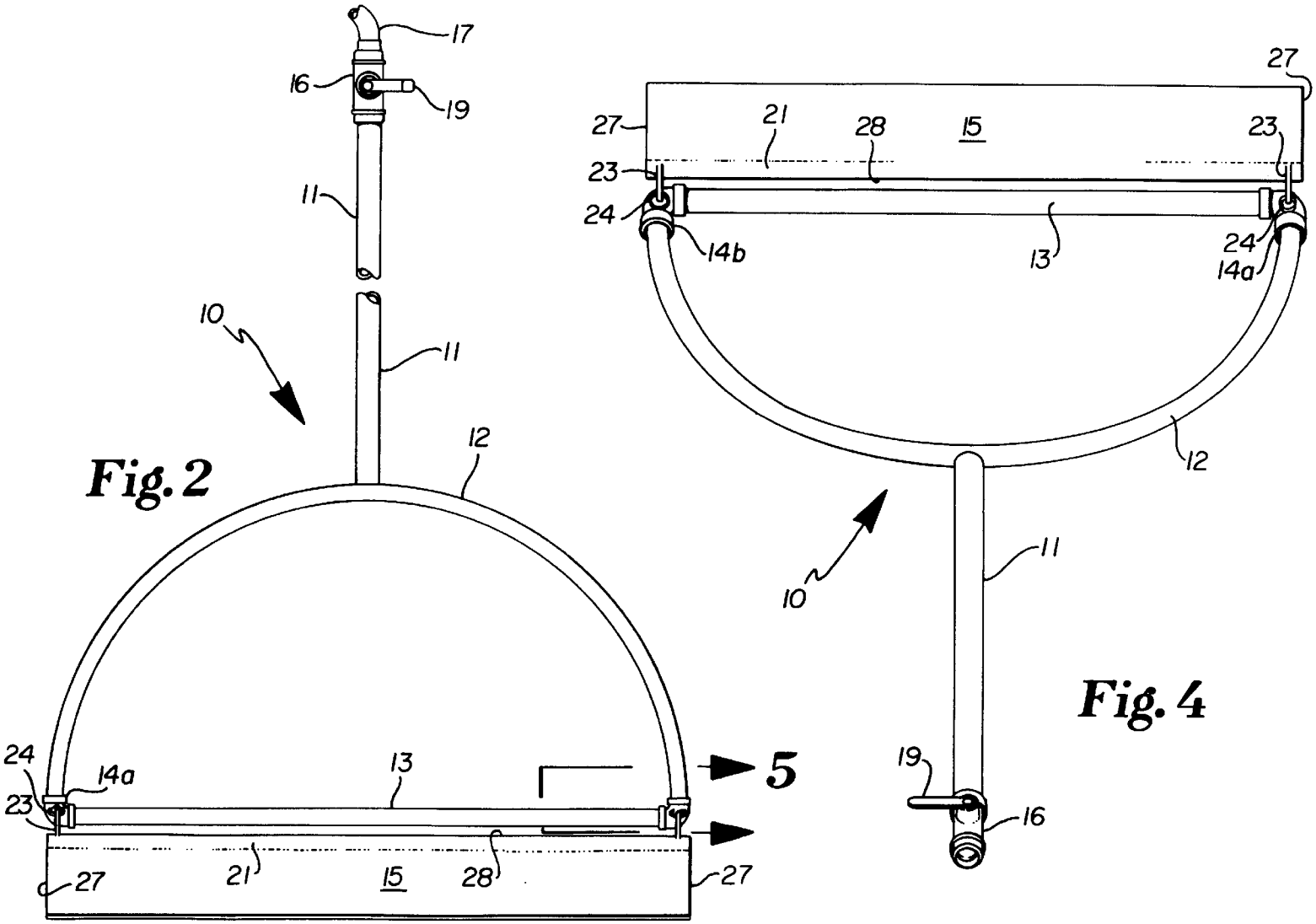
FIG. 2 is a back view of the ice tool.
FIG. 4 is a top view of the ice tool.

The water dispensing member 13 is hollow. As shown in FIG. 5, a plurality of apertures 25 arranged in a predetermined pattern at about 1.875 inch intervals on the bottom side of the dispensing member 13 dispense water on the external surface. The water is dispensed in front of the mat member 15. The water flow 20 is further distributed by the mat member 15, which, when in an operative orientation, is in contact with the external surface or ice. The water flow is smoothed evenly over the existing rink surface by the mat member 15 to form a smooth, thin new layer of ice 62.

Referring again to FIGS. 1–4, the mat 15 is preferably constructed of cotton or poly-cotton blend, but may be constructed of a variety of natural and/or synthetic woven or non-woven fabrics. The longitudinal mat is approximately 9 inches wide and is of the same length as the water dispensing member 13.

A rod 22 approximately the same length as the mat and preferably made of metal is inserted into the rod pocket 21 formed at the top edge 28 of the mat member 15. The rod 22 works cooperatively with clips to attach the ice tool to rings located on the back of base member 12.The mat 15 can be removed easily from the ice tool by releasing the clips. The mat 15 should be removed and dried when the tool is not in use or when it is in storage.

Foot members 29 and b are preferably disposed at the sides and bottom of the base member 12. The foot members contact the ice to raise the ice tool a predetermined distance away from the ice or other external surface. Importantly, an appropriate space 26 is maintained between the water dispensing member 13 and the rink ice or contact surface thereby improving the even dispersment of a water flow 20 onto the base ice 60 and the distribution of the water flow by the mat member 15.

An optional 16 inch piece of reinforced rubber hose used independently or in conjunction with an optional quick disconnect connector 18 will help prevent the external water supply hose, attached to the tool at its distal end, from kinking while the tool is in use. The quick disconnect 18 also provides means to disconnect the ice tool from the water source without interrupting the external water supply at its source.

Figure 6:
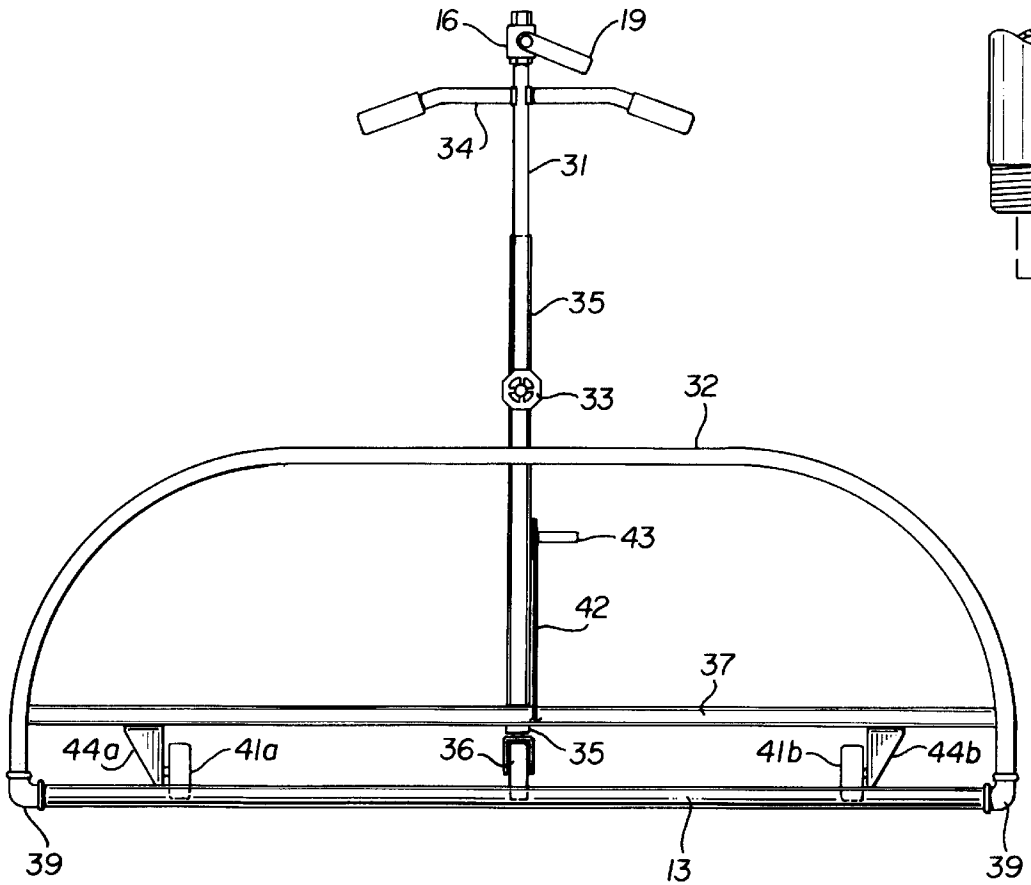
FIG. 6 is side view of a second embodiment of the ice tool.
Figure 8:
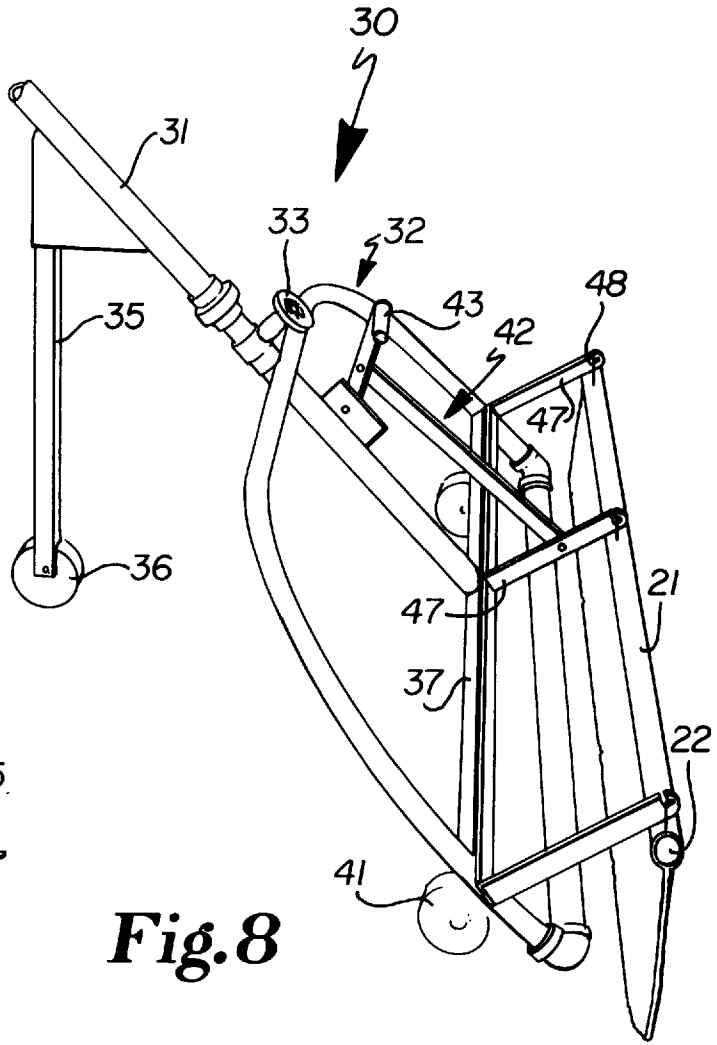
FIG. 8 is a side view of the ice tool showing adjustment features and with the mat in the up position.
Figure 7:
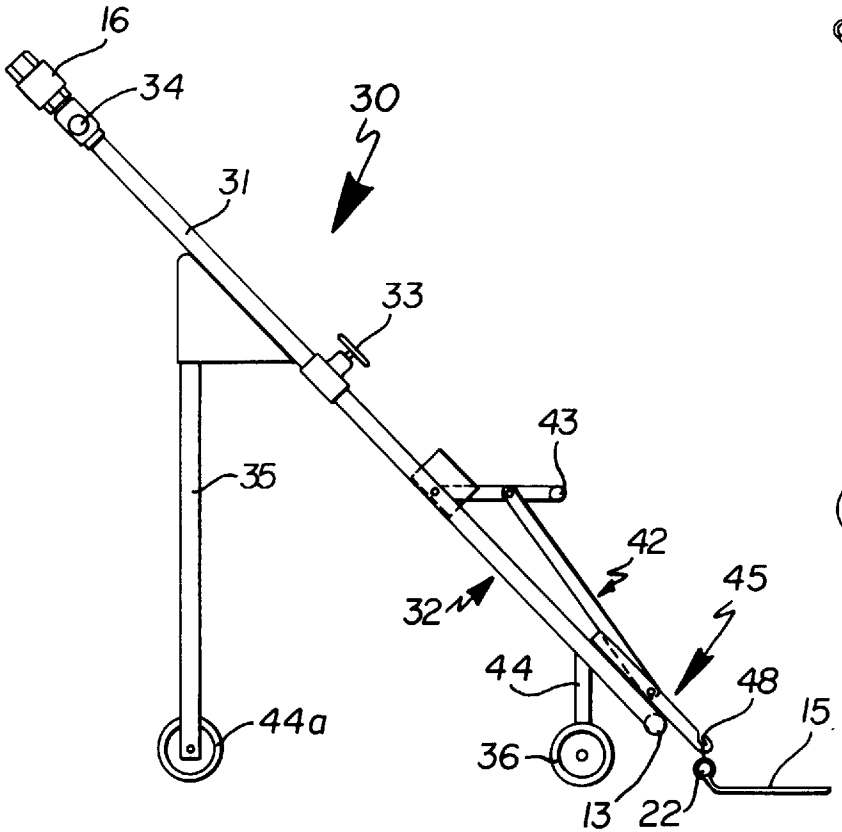
FIG. 7 is a side view of the ice tool in use with the mat in the down position.

The second embodiment of the ice tool as shown in FIGS. 6–8, is generally referred to by the reference number 30. Ice tool 30 has a handle 31, a base member 32, a water dispersing member 13, a mat 15 and a mat control apparatus comprising a pivoting lever 43 and toggle linkage 42.

The handle 31 is preferably 1 inch in diameter metal, however, it could vary in diameter and material. A valve 16 for connection to an external water supply is disposed at the proximal end of handle 31. The valve 16 has a lever 19 that pivots to close the valve and/or temporarily interrupt the water supply. In addition, at least one other water regulating member 33 can be located in the handle 31. A pushing member 34 is attached toward the proximal end of handle 31 and provides a method for the user to maneuver the ice tool 30 on the ice or other external surface.

The base member 32 of ice tool 30 is an elongated semi-oval that is preferably hollow and made of metal however, it can be a different configuration and made from other materials. The base member 32 is attached to a water dispensing member 13.

The water dispersing member 13 is constructed of metal or PVC. The dispersing member 13 has a plurality of apertures 25 distributed at 1.875 inch intervals in a predetermined pattern for distributing a water flow 20 onto an external surface or ice 62. The water flow 20 is further distributed by a mat member 15 supported on the base by a pivoting apparatus 45.

The pivoting apparatus 45 comprises a longitudinally oriented frame member 46 and a plurality of latitudinal oriented arms 47*a, b, c*. The distal end of the linkage member 42 is attached to the center arm 47*b* of the pivoting apparatus 45.The apparatus 45 is connected to a horizontal base member 37 of base 32. The pivoting apparatus 45 is attached to and operated by a linkage mechanism 42 and lever 43 that is also connected to the handle 31. The lever 43 also pivots in its bracket to allow a user to raise away from or lower the mat member 15 onto the ice surface 6.

Figure 10:
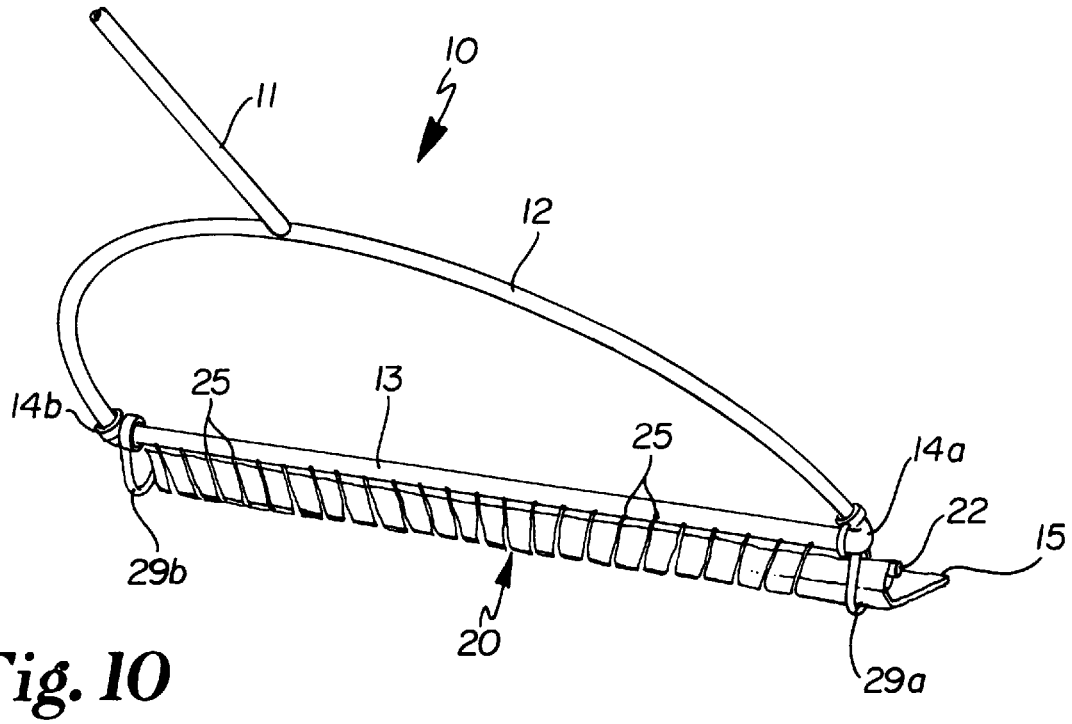
FIG. 10 is a perspective showing details of the bottom end of the ice tool.
Figure 11:
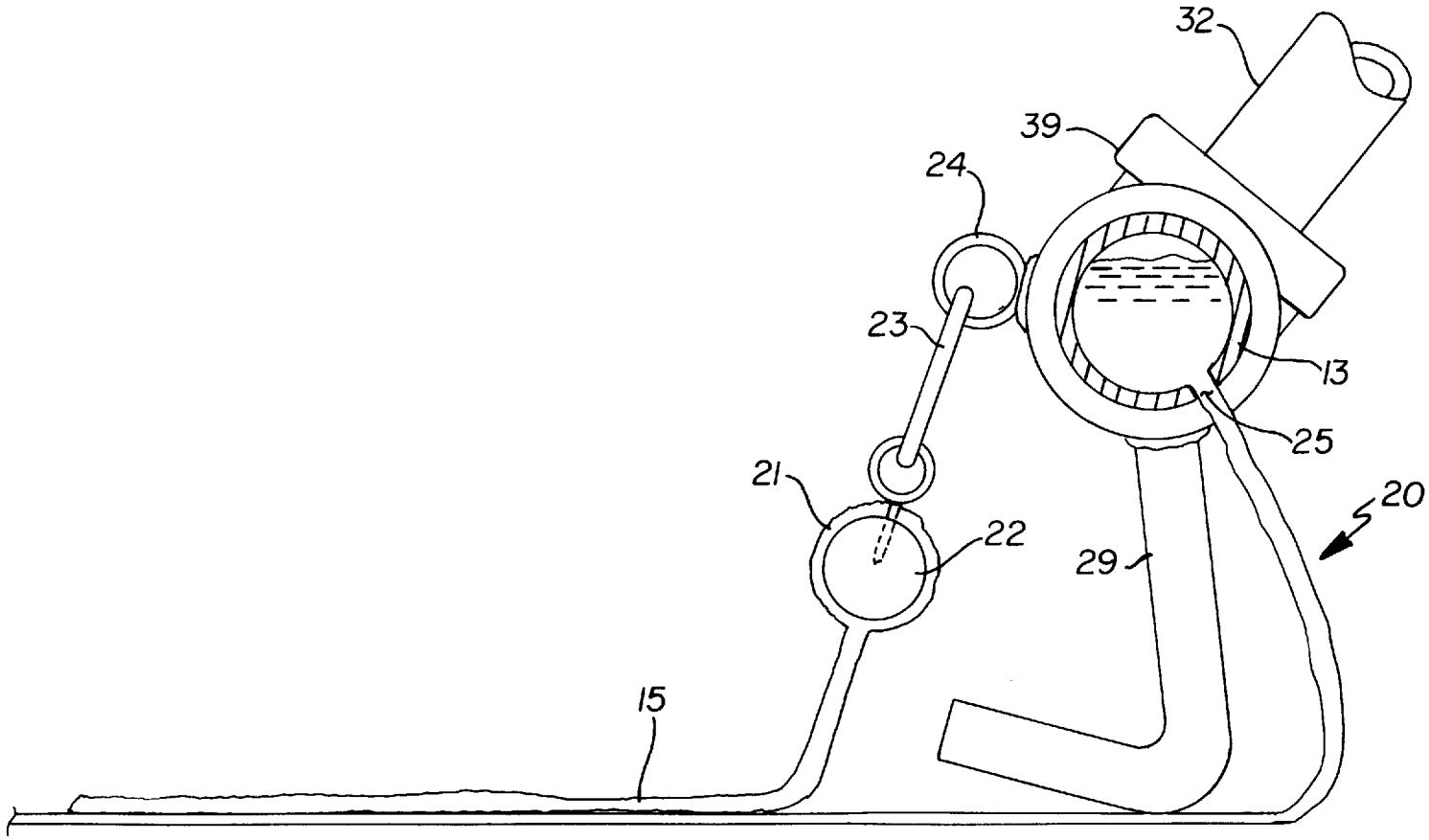
FIG. 11 is a bottom end view showing details of the mat of the ice tool.

In the down position, as shown in FIG. 7, 10 and 11, the mat member 15 functions to disperse the water flow 20 across the ice surface. In its raised position, as shown in FIG. 8, the mat member 15 does not contact an external surface and is, therefore, prevented from freezing onto the ice.

As shown in FIG. 6–8, a stand member comprising a vertical stand member 35 which has a wheel 36 at its distal end and a pair of wheels 41*a,b* attached by brackets 44*a,b* to a horizontal frame member 37 work cooperatively to provide a stand and a method of maneuvering the ice tool across the ice or other surface. In addition, the vertical support member 35 determines the correct orientation of the ice tool 30 to the ice.

The ice tool 30 is particularly adaptable for larger, indoor ice rinks, although, it can be utilized on outdoor rinks as well. A benefit of the ice tool in general and, of this embodiment in particular, is that it is manually operated and will not produce emissions to pollute the air in an indoor facility. This tool also eliminates the need for caulking or sealing between the dasher and the floor of indoor rinks because the water will stay (freeze) where the ice tool and mat member 15 distribute it. Another advantage of this tool is it makes installation of lines and logos on the ice easy because of the superior, smooth surface that is achieved when the ice tool is used. The thin layer of ice applied over base ice with this tool is less apt to chip or peel as it does when water is applied with a hose. The thin layers bond well with each other as the ice is formed.

The optional quick disconnect connector 18 and optional 16 inch reinforced 100 percent rubber hose 17 can also be used with this embodiment. The quick disconnect 18 acts as a swivel to keep the water supply hose from kinking or getting in the users path while the ice is being built or reconditioned.

Figure 12:
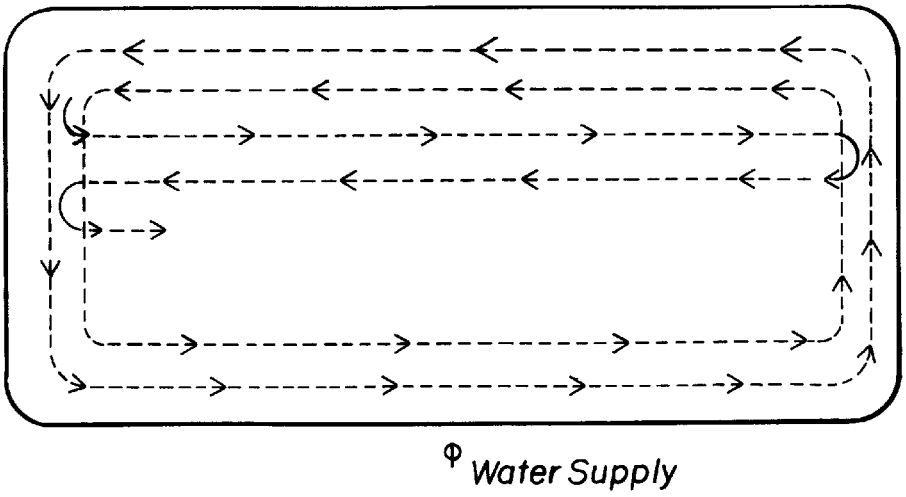
FIG. 12 is a diagram illustrating a method of using the ice tool to create a rink.

As shown in FIG. 7, the user maneuvers the ice tool 30 over the ice by holding onto the pushing bar 34. An existing base layer 60 can be reconditioned in minutes by maneuvering the ice tool across the base ice in a predetermined pattern and moving from the far side of the rink across the entire rink surface, as shown in FIG. 12.

The ice tool 30 is preferably 66 inches wide, however, it can be made in different widths. It weighs approximately 40 pounds and is most suitable for making and reconditioning ice on large rinks of 7500 square feet and larger.

Figure 9:
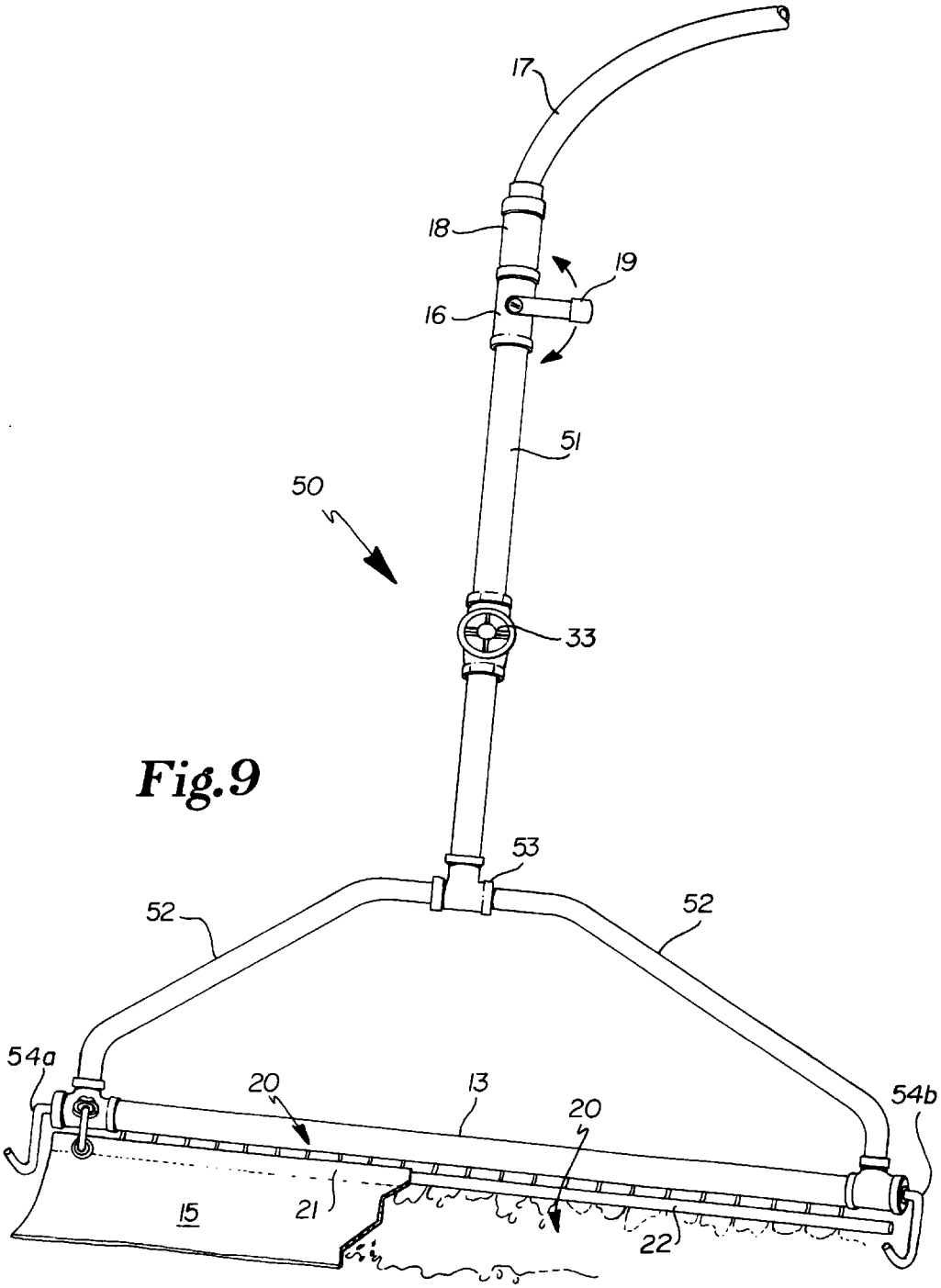
FIG. 9 is a perspective back view of a third embodiment the ice tool.

As shown in FIG. 9, the third embodiment of the ice tool is generally referred to by the reference number 50. This embodiment comprises a handle 51, a base member 52, feet members 54*a* and *b*, and a mat member 15. This embodiment is recommended for use on indoor or outdoor ice rinks between 3000 and 7500 square feet in size.

The handle 51 is preferably ¾ in diameter, but could be a different diameter. It has a proximal end with a connector 16 for attachment to a ¾ inch water hose and/or the optional quick disconnect member 18. The handle 51, optionally, can contain additional water regulating valves anywhere along its length. The handle is preferably made of metal. A hollow T-fitting 53, or other appropriate apparatus or means, might be used to attach the distal end of the handle 51 to the base member 52. Additionally, the handle 51 and base member 52 can be constructed as a single unit.

The handle 51 and base member 52 are preferably hollow and serve as a conduit for water, although, a water supply hose could be attached to an optional solid handle by various methods and then connected to the water dispersment bar 13.

The base member 52 is cylindrical, hollow and, preferably constructed of metal, although other materials could be used. A water dispersing member 13 is connected to the bottom side of base member 52 by threaded elbow members or other suitable connectors.

The water dispersing member 13 and mat member 15 of this embodiment function in the same manner as previously described for the first embodiment. The top edge 28 of mat 15 is attached preferably by at least two clips 23, or other appropriate connecting methods, to a ring 24 extending away from the elbow fittings 44*a* and *b*. The mat 15 is preferably constructed of cotton or a poly-cotton blend, but may be constructed of a variety of natural and/or synthetic woven or non-woven fabrics. The mat member 15 is approximately 9 inches wide and its length is determined by the length of water dispersing member 13.

The foot members 54*a* and *b* are disposed at the sides and bottom of the tool 50. The foot members 54*a* and *b* contact the ice surface to raise the base 52 and water dispersing member 13 away from the ice.

An optional 16 inch piece of reinforced 100 percent rubber hose used independently or in conjunction with an optional quick disconnect connector 18 act as a swivel mechanism and will help to prevent the water supply hose from kinking while the tool is in use. The quick disconnect 18 also provides a way to disconnect the ice tool from the water source without interrupting the water supply at its source.

Figure 13:
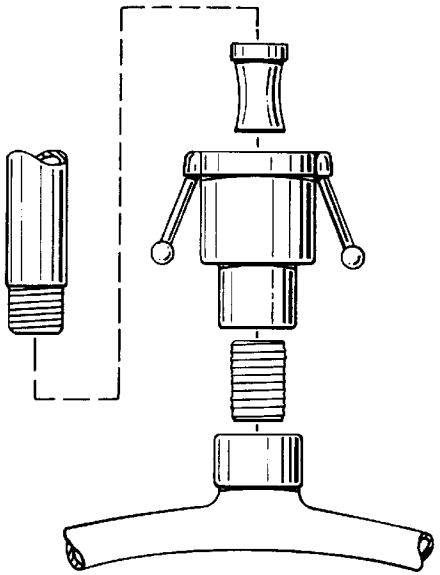
FIG. 13 is a quick disconnect fitting to attach and/or remove the handle from the base of the frame structure for convenience of shipment and storage.

FIG. 13 shows a connection member 50 which is optionally used to connect the handle 11 to the base 12. The member 50 permits collapse of the frame for storage or transportation.

II. MODE OF OPERATION AND METHOD OF USE.

A. BASE ICE CREATION.

Snow is removed from rink area. No liner is necessary to keep the water in place on the rink, however, sideboards or banking made from snow will define the limits of the ice rink if that is desirable. Subsequently, a mist of water is applied from a standard garden type hose and sprayer over the prepared rink area. The spray will produce a glaze over the entire surface. After a glaze covers the rink area, the ice tool attached to a water hose and external water supply source, as defined in FIG. 12. To create base ice, it is desirable to apply a plurality of thin layers of water until approximately 2 inches is built up.

Figure 3:
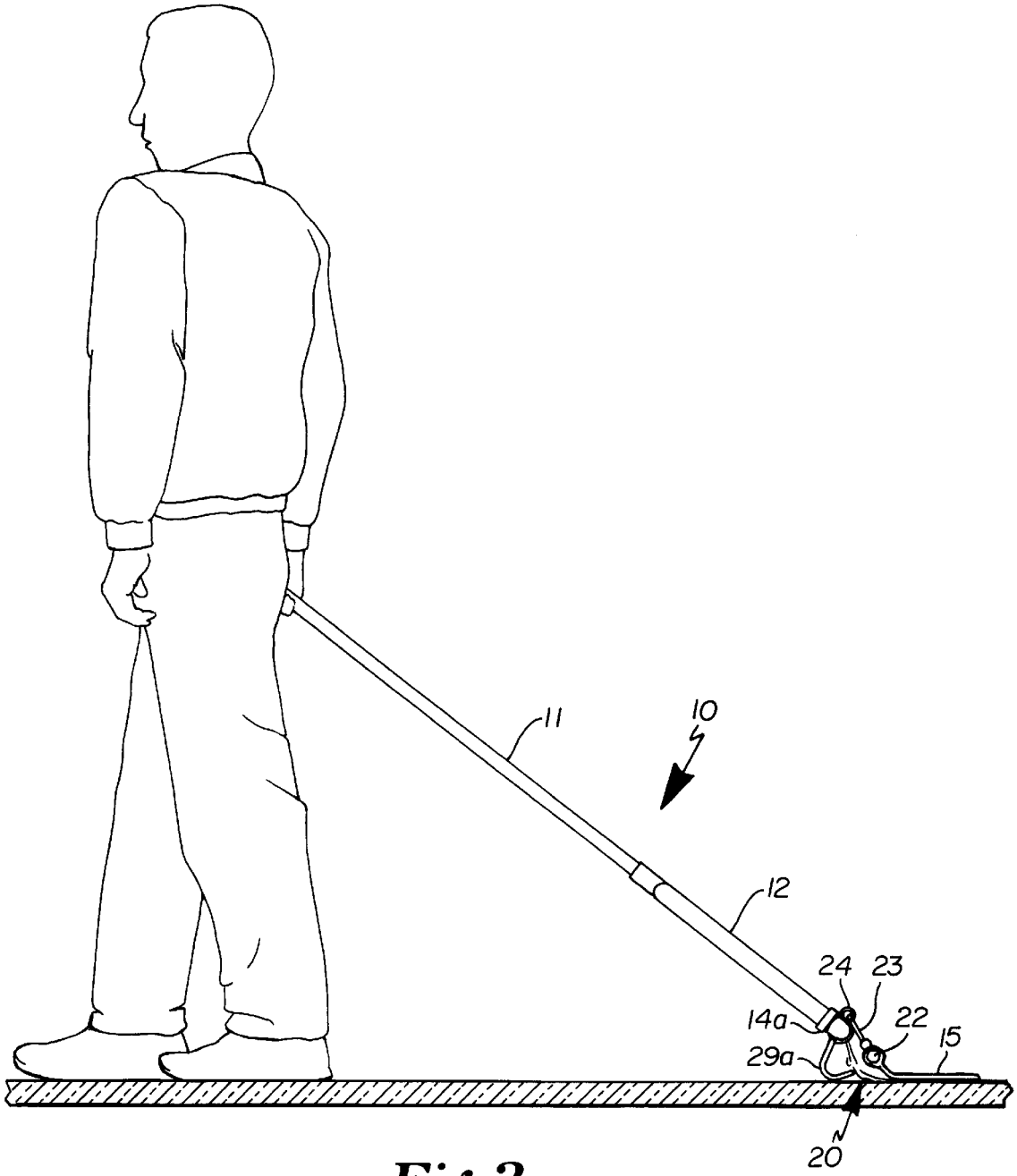
FIG. 3 is a side view of the ice tool in use.

For ease of operation, it is desirable for the user to start at the farthest side of the rink and work back and forth towards the side the water supply is on, as is shown in FIG. 12.Two complete passes will be made around the rink with the ice tool and water hose held as shown in FIGS. 3 and 10. Walking forward with the ice tool held to the side works best to insure proper operation of the ice tool.

It is desirable to keep the water from flowing out and away from the sides 27 of the mat member 15. Water pressure from the external supply is regulated with valve 16 and/or regulator member 33 located on the handle of the ice tool.

B. ICE RESURFACING.

With the skaters removed from the rink, the best results can be obtained by first scraping off all snow and ice shavings. Some water should be run onto the ice before beginning to use the ice tool in order to prevent the mat member 15 from freezing down to the ice. This will happen when a wet mat member 15 comes into contact with the ice. In the event the mat member 15 does freeze to the ice, it can be removed by first letting water run on to the ice in the area of the mat member. When the ice is sufficiently wet, tugging gently on the mat member 15 will loosen it from the ice. Hard tugging can cause the mat member 15 to tear.

The entire rink surface should be covered by working back and forth towards the side the water supply is on as previously described. Multiple passes over the ice with the tool will create a flat, high quality ice with a smoother finish.

The descriptions above and the accompanying drawings should be interpreted in the illustrative and not the limited sense. While the invention has been disclosed in connection with the preferred embodiment or embodiments thereof it should be understood that there may be other embodiments which fall within the scope of the invention as defined by the following claims. Where a claim is expressed as a means or step for performing a specified function it is intended that such claim be construed to cover the corresponding structure, material, or acts described in the specification and equivalents thereof including both structural equivalents and equivalent structures.

What is claimed is:

1. An ice making and reconditioning tool comprising:

(a) a frame structure including a handle and a base;

(b) a fluid dispensing member connected to said base, wherein said fluid dispensing member dispenses fluid on an external surface, and wherein said external surface is a base surface upon which ice is to be formed or is ice;

(c) a mat member connected to said base for contact with said external surface;

(d) means to provide fluid to said fluid dispensing member; and (e) a frame support stand assembly comprising a vertical support member located and extending downwardly from an underside of said handle, said vertical support member having a wheel at a distal end thereof, said stand assembly further comprising at least two wheels attached by at least one bracket to a horizontal support member of said base, all of said wheels are being adapted for contact with said external surface.

2. The tool of claim 1, wherein said frame structure is, rigid, hollow and has a continuous inner lumen, said inner lumen being communicatively connected to said fluid dispensing member, said inner lumen being said means to provide fluid.

3. The tool of claim 2, wherein said frame structure further comprises, at least one fluid control valve connected to said handle to control fluid flow to said fluid dispensing member.

4. The tool of claim 2, wherein said hollow handle is adapted for quick disconnection from an external water source by a swivable quick disconnect member, said quick disconnect member disposed at a proximal end of said handle, said quick disconnect member being further adapted for connection to a piece of reinforced rubber hose.

5. The tool of claim 1, further comprising a pushing member, wherein said pushing member is attached to said handle by a bracket.

6. The tool of claim 1, wherein said wheels of said stand permit maneuvering of said frame structure and, wherein said wheels raise said frame structure a predetermined distance away from said external surface.

7. The tool of claim 1, further comprising a mat control mechanism, said mat control mechanism comprising:

(a) a first lateral bar member connected to said base;

(b) a second lateral bar member connected to said mat member;

(c) a plurality of longitudinal arm members each having a proximal end connected to and pivotally extending from said first lateral member and a distal end connected to said second lateral member; and (d) a lever mechanism connected to said handle and to at least one of said longitudinal arm members, said lever mechanism being constructed and arranged to pivotally raise and lower said mat member away from and into contact with the external surface.

8. The tool of claim 1, wherein said fluid dispensing member is connected at a distal end of said base of said frame structure.

9. The tool of claim 1, wherein said fluid dispensing member is a hollow tube, said hollow tube has a plurality of apertures disposed in a predetermined pattern for dispensing of water onto said external surface.

10. The tool of claim 1, further comprising at least one foot member connected said base of said frame structure for contact with said external surface to raise said fluid dispensing member a predetermined distance away from said external surface.

11. The tool of claim 1, wherein said mat member is connected to said base by at least two clips.

12. The tool of claim 1, wherein said mat member is adapted for contact with said external surface and, wherein said mat member distributes said fluid flow from said fluid dispensing member apertures over said external surface in a generally thin layer.

13. The tool of claim 1, wherein said fluid dispensing member has a predetermined length, and wherein said mat member has a length equivalent to said fluid dispensing member length.

14. A portable, hand operable ice making and reconditioning tool for use in forming or maintaining a skating ice rink by layering thin layers of water onto an external surface, comprising:

(a) a rigid frame structure including a handle and a base, said frame structure being hollow and having a continuous inner lumen;

(b) means to connect said frame structure lumen to an external water source;

(c) a fluid dispensing member connected to said base, said fluid dispensing member being a hollow tube communicatively connected to said frame structure lumen and having a plurality of apertures disposed therein, said fluid dispensing member dispensing water through said apertures and onto said external surface, and wherein said external surface is a base surface upon which ice is to be formed or ice; and (d) a mat member connected to said base, said mat member being adapted for contact with said external surface and, wherein said mat member evenly distributes said water flowing from said fluid dispensing member apertures over said external surface in a generally thin layer for uniform ice formation.

15. A portable, hand operable ice making and reconditioning tool for use in forming or maintaining a skating ice rink by uniformly spreading thin layers of water onto a cold external surface, comprising:

(a) a rigid frame structure including a handle and a base, said frame structure being hollow and having a continuous inner lumen;

(b) means to connect said frame structure lumen to an external water source;

(c) at least one water control valve connected to said frame structure and communicatively connected to said lumen;

(d) a water dispensing member connected to said base, said fluid dispensing member being a hollow tube communicatively connected to said frame structure lumen and having a plurality of apertures disposed therein, said water dispensing member dispensing water through said apertures and onto said external surface, and wherein said external surface is a base surface upon which ice is to be formed or ice;

(e) a flexible cloth mat member connected to base, said mat member being adapted for contact with said external surface and, wherein said mat member evenly distributes said water flowing from said water dispensing member apertures over said external surface in a generally thin layer for ice formation; and (f) means, connected to said frame structure, to raise said water dispensing member a predetermined distance from the external surface.

16. A portable, hand-operated ice making and reconditioning tool for building and resurfacing an ice rink through a process of applying one or more thin layers of water onto an external surface, wherein the thin layers freeze quickly and solidly to form a smooth surface, the tool comprising:

(a) a frame structure including a handle and a base, said frame structure having a size and weight to allow a single user to move said tool by grasping said handle;

(b) a water dispensing member connected to said base, wherein said water dispensing member dispenses water on said external surface, wherein the external surface is a base surface upon which ice is to be formed or is ice;

(c) a mat member connected to said base for contact with said external surface, wherein said mat member evenly spreads said dispensed water into an effectively thin layer for uniform ice formation; and (d) a water supply mechanism to provide water to said water dispensing member.

17. A method of making and resurfacing ice using a portable, hand operated ice making and reconditioning tool that comprises a frame structure including a handle and base, a fluid dispensing member connected to the base, and a trailing mat member connected to the base for contact with the external surface, said method comprising the steps of:

(a) removing snow, ice shavings, and other debris from the external surface;

(b) connecting a hose to the ice making and reconditioning tool to provide a supply of water to the fluid dispensing member, said hose being connected to an external water source;

(c) operating a valve to regulate water flow through the fluid dispensing member onto the external surface; and (d) manually moving the tool on the external surface via the frame structure while regulating the water flow beneath the mat member so that a layer of water is applied onto the external surface and spread thinly by the trailing mat member to enable the water to freeze quickly and solidly.

18. The method of making and resurfacing ice using a portable, hand operated ice making and reconditioning tool of claim 17, further comprising the step of applying a desired number of additional thin layers of water after the previous layer has frozen to either build or resurface the ice base.

* * * * *